US006473919B1

(12) United States Patent
Wang

(10) Patent No.: US 6,473,919 B1
(45) Date of Patent: Nov. 5, 2002

(54) PIVOTAL SEAT FOR A COLLAPSIBLE PLAYPEN

(76) Inventor: Kun Wang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/969,630

(22) Filed: Oct. 4, 2001

(51) Int. Cl.[7] ..... A47D 7/00
(52) U.S. Cl. ..... 5/99.1; 5/98.1
(58) Field of Search ..... 5/93.1, 98.1, 98.3, 5/99.1

(56) References Cited

U.S. PATENT DOCUMENTS 5,465,439 A * 11/1995 Chien ..... 5/99.1
5,697,111 A * 12/1997 Dillner et al. ..... 5/93.1
5,819,342 A * 10/1998 Williams ..... 248/167
5,937,457 A * 8/1999 Wang ..... 5/98.1
6,295,667 B1 * 10/2001 Cheng ..... 5/99.1
6,336,234 B1 * 1/2002 Kuo ..... 5/93.1
6,349,434 B1 * 2/2002 Zhuang ..... 5/98.1

* cited by examiner

*Primary Examiner*—Michael F. Trettel

(57) ABSTRACT

A pivotal seat for a collapsible playpen includes a pivotal seat at lower center of a playpen and having a foot and four inverse U-shaped branches on four sides perpendicular to each other two of them having check surfaces and arcuate surfaces for pivoting a pair of elastic rods, the other two of them without the above arrangements for pivoting a pair conventional rod, a T-shaped member embedded into a central bore of the seat including a pair of symmetrically formed rotors superimposedly wrapped on and biased by a pair of coil springs for actuating the elastic rods in and out of the branches and a cover with a handle rotatably secured to the seat to control the movement of the rotors. The elastic rods are motionless when the playpen is flattened. If rotates the cover clockwise for a certain span, the elastic rods are set free to enable the playpen to be collapsed.

8 Claims, 8 Drawing Sheets

PIVOTAL SEAT FOR A COLLAPSIBLE PLAYPEN

BACKGROUND OF THE INVENTION

The present invention relates to playpen and more particularly to a pivotal seat for a collapsible playpen.

The structure of conventional playpen is combined with a plurality of vertical posts and a plurality of horizontal rods. A typical collapsible playpen has a pivotal seat positioned at lower center of the playpen and pivotally connected to four corner members by four horizontal rods. The pivotal seat is operated up and/or down to collapse or flatten the playpen which is very convenient. However, the pivotal seat has different kind of structure. Most of them lack a locking arrangement so as to cause the flattening of the playpen uncertain and unstable.

SUMMARY OF THE PRESENT INVENTION

The present invention has a main object to provide a pivotal seat for a collapsible playpen which includes a pair of controllable horizontal rods to insure the operation of the collapsible playpen more reliable.

Accordingly, the pivotal seat for a collapsible playpen of the present invention comprises generally a pivotal seat at lower center of the playpen having a foot on bottom, four inverse U-shaped branches radically extended outward for horizontal pivoting a pair of elastic rods and a pair of conventional rods. The elastic rods are operated by a control device which includes a T-shaped member embedded into a central bore of the seat, a pair of symmetrically formed rotors wrapped on an axial tube of the T-shaped member and biased by a pair of coil springs, a cover covering the rotors and a handle pivoted to the cover. When pulls the seat upward, the playpen is collapsed and when pushes down the seat, the playpen is flattened.

The present invention will become more fully understood by reference to the following detailed description thereof when read in conjunction with the attached drawings.

DETAILED DESCRIPTION OF THE PREFERRED EMBODIMENT

Figure 1:
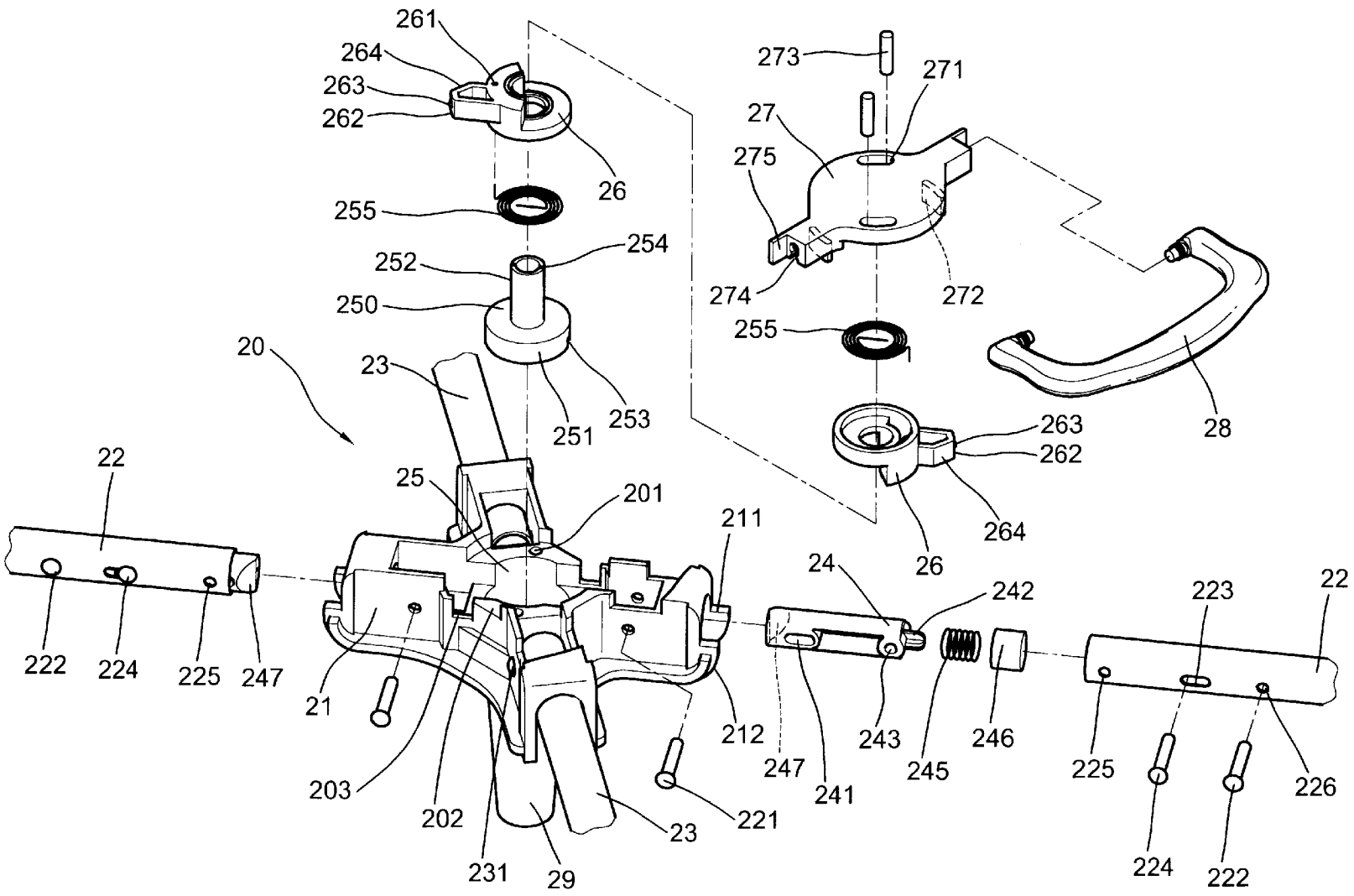
FIG. 1 is an exploded perspective view to show a preferred embodiment of the present invention.
Figure 2:
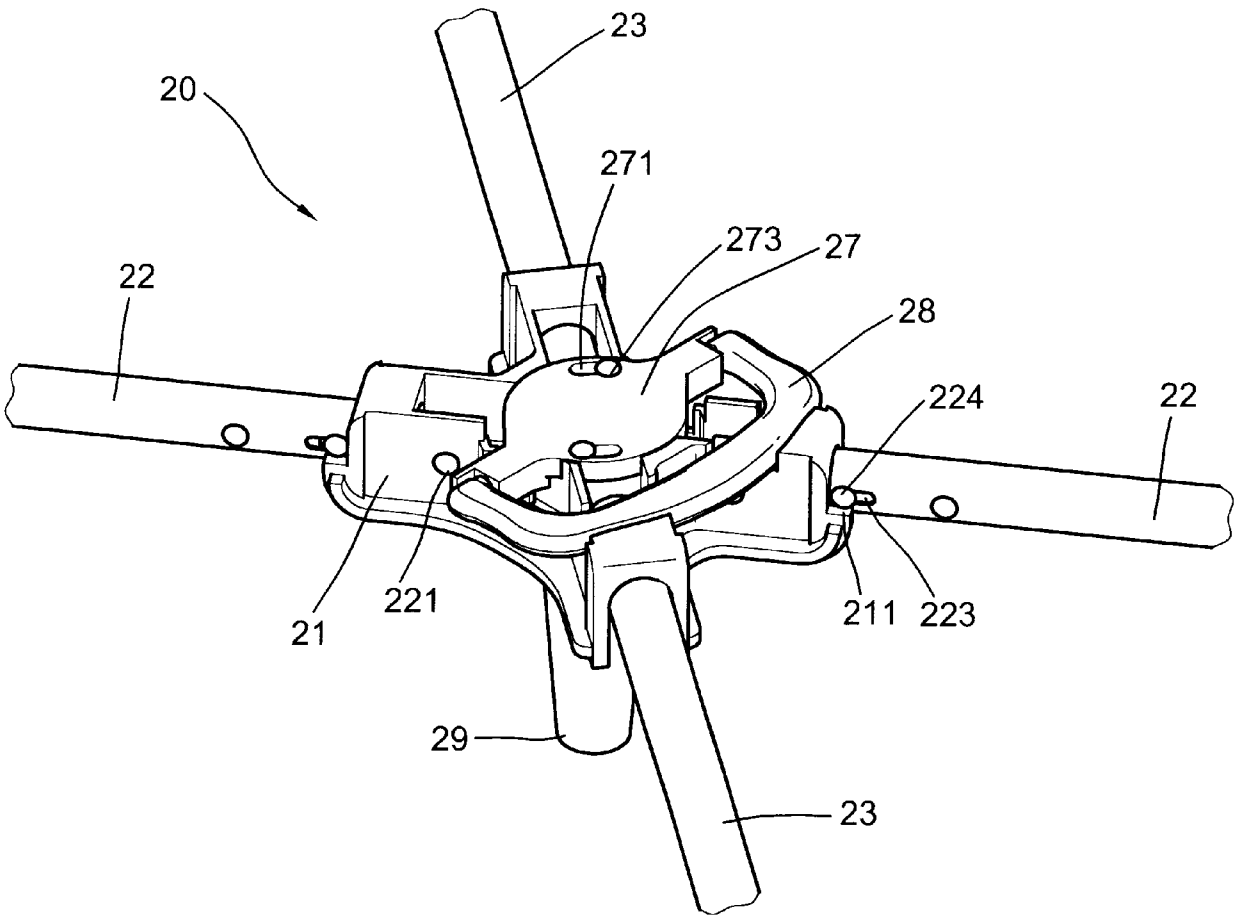
FIG. 2 is a perspective view to show the assembly of FIG. 1.
Figure 3:
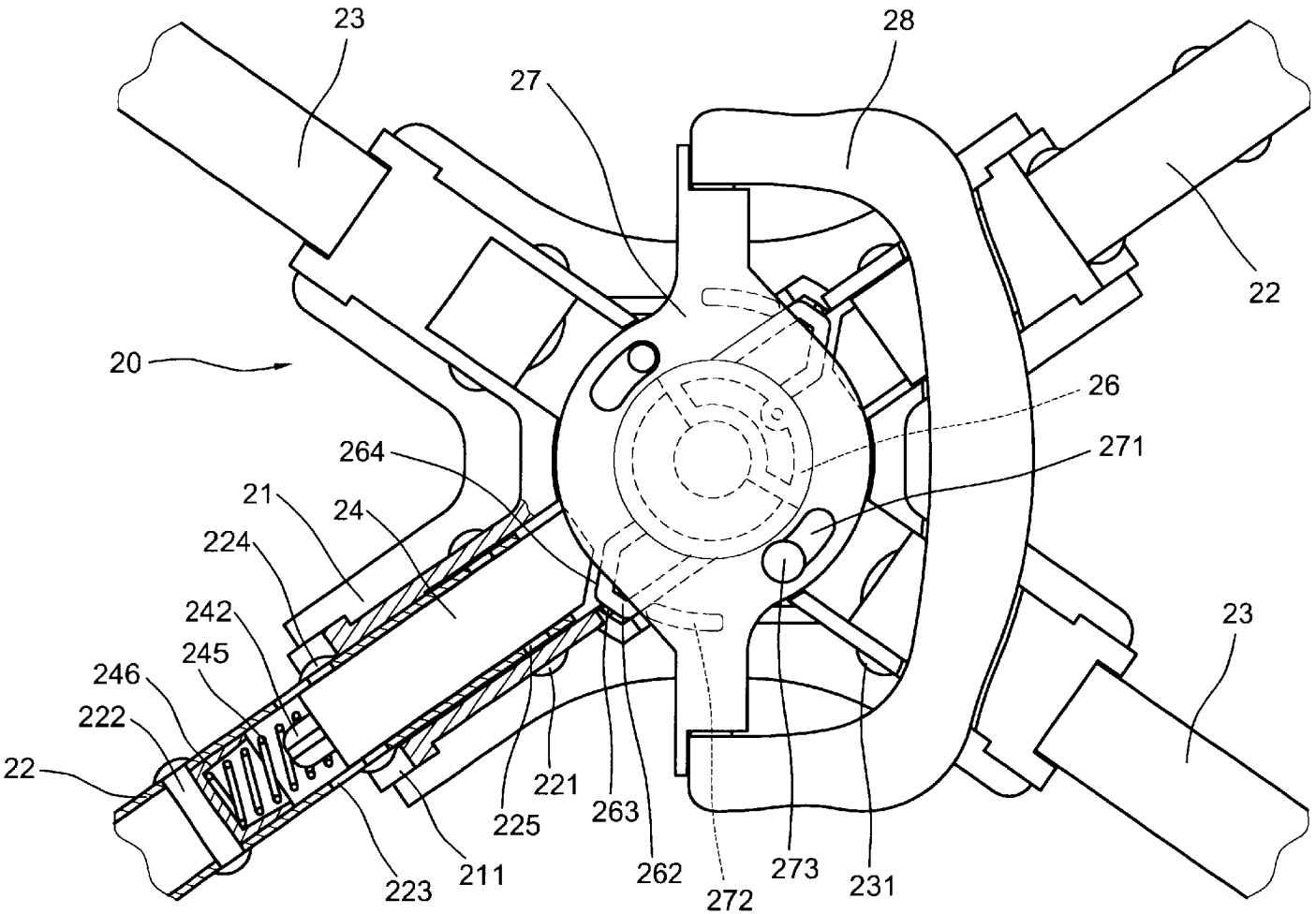
FIG. 3 is a top view with partial sectional view of FIG. 2.
Figure 4:
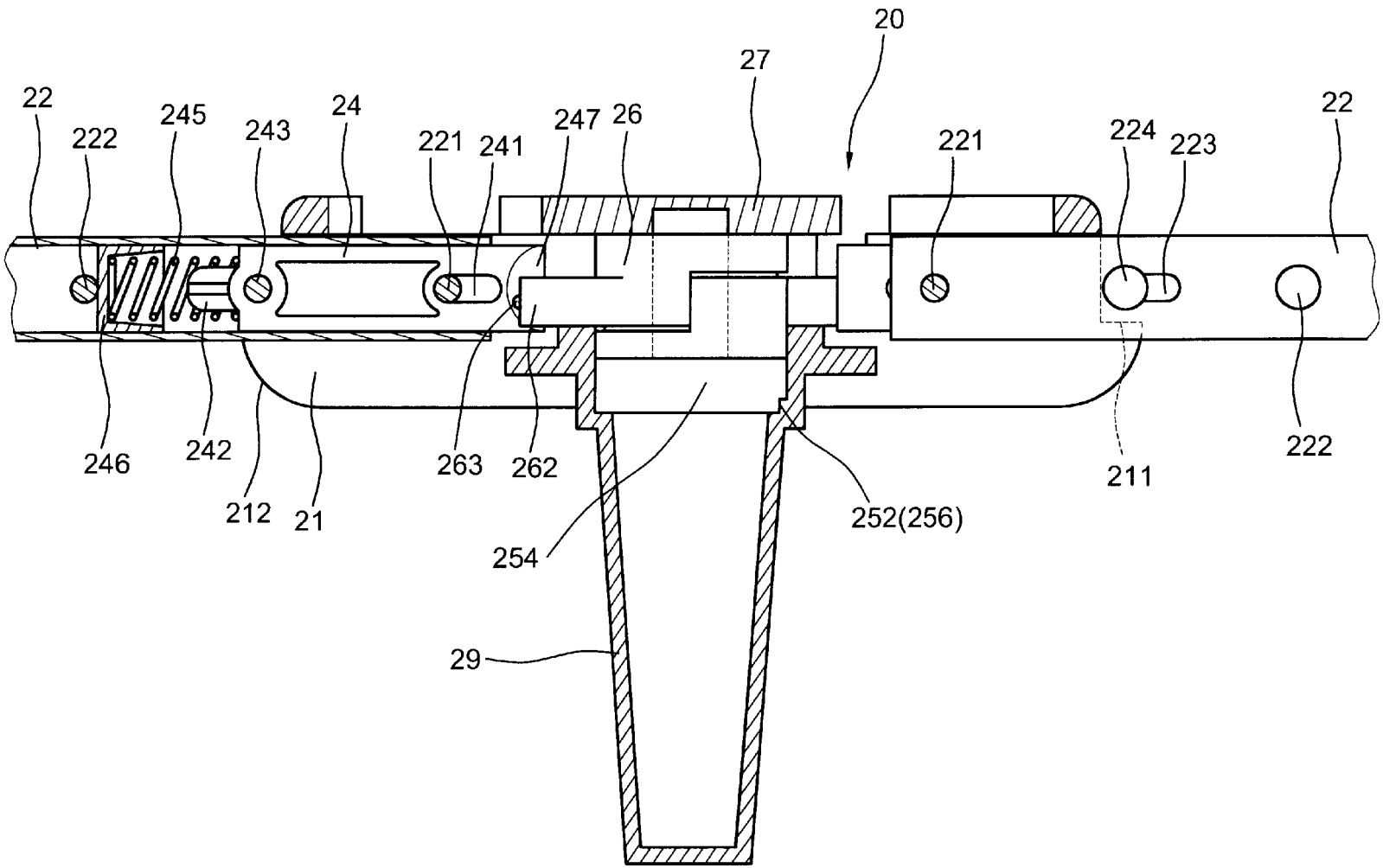
FIG. 4 is a sectional view of FIG. 2, while the playpen is flattened.
Figure 7:
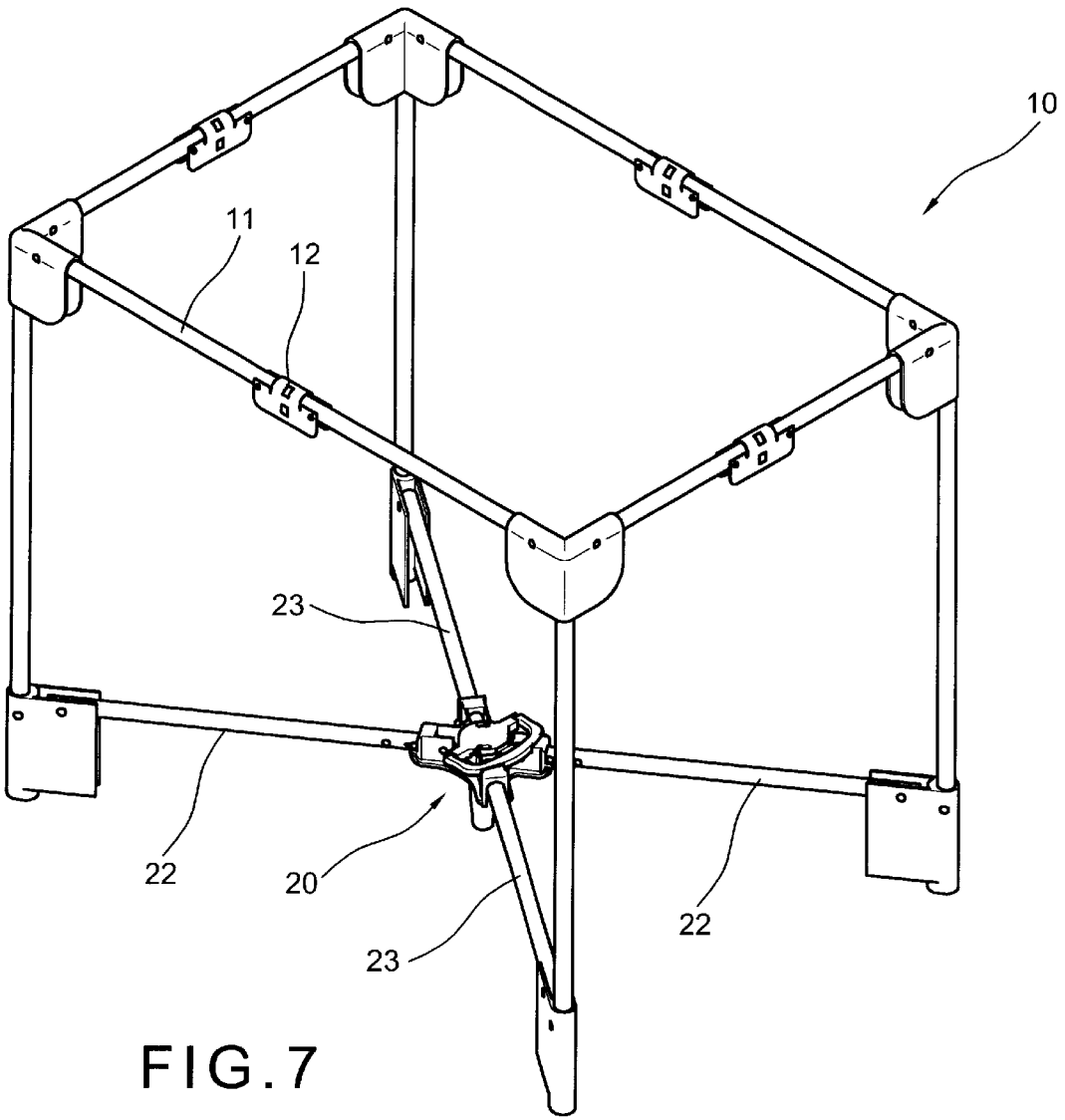
FIG. 7 is a perspective view to show that the pivotal seat of the present invention is used in a playpen.

With reference to FIGS. 1, 2 and 7 of the drawings, the pivotal seat for a collapsible playpen of the present invention comprises a pivotal seat 20 at lower center of a collapsible playpen which has a plurality of rails 11 on the top each including an adapter 12 at a middleportion. The seat 20 has four horizontal inverse U-shaped branches 21 projected outward from four sides perpendicular to each other for respectively pivoting a pair of elastic rods 22 and a pair of conventional rod 23 by rivets 221 and 231 through the first aligned thru holes in the lateral walls of the branches 21, a foot 29 extending downward from the bottom of the seat 20, a central bore 25 including a knot 256 on an inner wall (as shown in FIG. 4), a pair of vertical holes 201 symmetrically formed in the upper rim of the central bore 25, a pair of moving spaces 202 symmetrically formed on the rim of the central bore abutting the vertical holes 201 respectively, a pair of slots 203 symmetrically formed at a position abutting the moving spaces 202, a pair of check surfaces 211 respectively formed at the end of the two branches 21 to which the elastic rod 22 are pivoted, and a pair of arcuate surfaces 212 respectively formed under the check surfaces 211.

Figure 5:
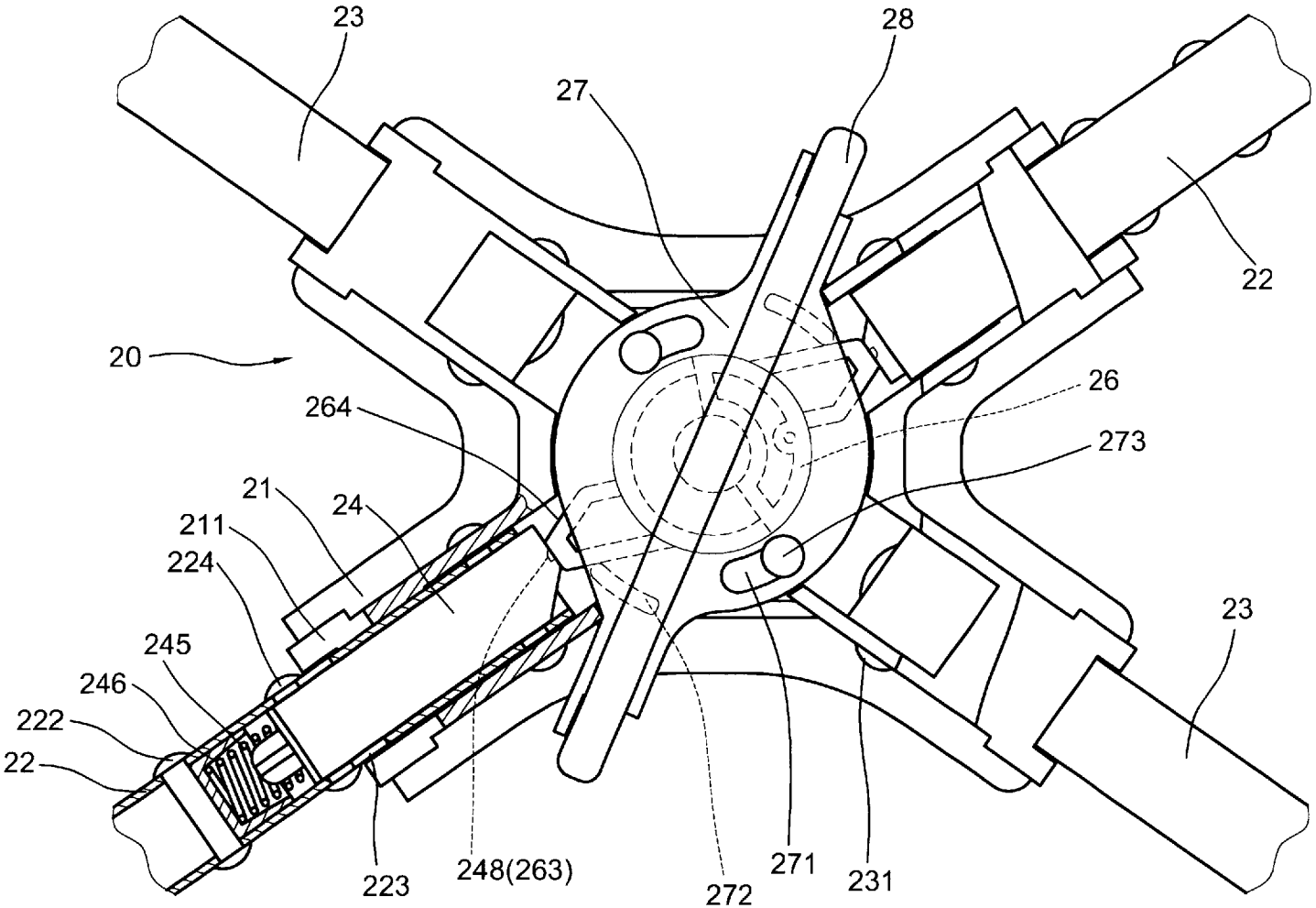
FIG. 5 is a top view of FIG. 2, while the rotors stop against the slides.

The elastic rods 22 each has a hollow interior, a second aligned thru hole 225 adjacent from tend for pivoting the elastic rod 22 to the branches 21 by rivet pins 221, a third aligned thru hole 226 in a peripheral wall, a first oblong hole 223 in a peripheral wall positioned between the second aligned thru hole 225 and the third aligned thru hole 226. A slider 24 inserted into the elastic rod 22 has a second oblong hole 241 adjacent front end engageable with the first aligned thru hole of the branches 21 the second aligned thru hole 225 of the elastic rod 22 and the rivet pin 221, a projection 242 at rear end for biasing a spring 245, a sleeve 246 sleeved on the spring 245 and stopped against a rivet pin 222 when the rivet pin 222 engages into the second aligned thru hole 226, a radial hole 243 adjacent the projection 242 engaged with the first oblong hole 223 and secured by a rivet pin 224, a bevel surface 247 at front end and a slot 248 centrally formed in the front end of the slider 24 (as shown in FIG. 5).

A roughly inverse T-shaped member 250 embedded into the central bore 25 of the seat 20 has a circular body 251 of a diameter equal to that of the central bore 25, an axial tube 252 centrally projected upward from the top of the circular body 251, a slot 253 in a periphery of the circular body 251 engaged with the knot 256 in the central bore 25 and a positioning slit 254 in a peripheral wall of the axial tube 252.

A pair of rotors 26 wrapped on the axial tube 252 of the inverse T-shaped member 250. The rotors 26 are symmetrically formed and combinable with each other and each has a vertical hole 261, a protrusion 262 on one side, a knot 263 at an outer end of the protrusion 262 engageable with the slot 248 of the slider 24 (as shown in FIG. 5) and a bevel portion 264 on one side of the protrusion 262 engageable with the bevel surface 247 of the slider 24.

A pair of coil springs 255 wrap on the axial tube 252 of the inverse T-shaped member 250 and respectively dispose at the top and the bottom of the pair of rotors 26. The coil springs 255 each has a vertical end inserted into the vertical hole 261 of the rotors 26 respectively and a transverse end inserted into the slit 254 of the axial tube 252.

A cover 27 covers on the top of the rotors 26 and the coil springs 255 and has a pair of arcuate holes 271 symmetrically formed in the top abutting the circumferential edges and respectively engaged with the first vertical holes 201 of the seat 20 and rotatably secured by a pair of retaining pins 273 so that the cover 27 can be rotated for a certain span on the seat 20 without moving up or downward, a pair of pushing plate 272 symmetrically formed on underside for pushing the protrusions 262 of the rotors 26 to turn laterally, a pair of inverse U-shaped thru holes 274 respectively formed in the ends of two protrudent portions for pivoting a semi-circular handle 28 therein and a pair of reinforcement plates 275 respectively formed abutting a lateral side of the thru holes 274. The handle 28 has a pair of tangs symmetrically formed at two ends toward each other.

Note that the moving spaces 202 of the seat 20 are provided to facilitate the lateral movement of the cover 27 and the slots 203 of the seat 20 are provided to facilitate the moving in or out of the pushing plates 272 of the cover 27.

Referring to FIGS. 2, 3, 4 and 7, when the elastic rods 22 and the conventional rods 23 are flattened at their horizontal positions, the rotors 26 are motionless, the rivet pins 224 of the sliders 24 stop against the check surfaces 211 of the branches 21 so that the elastic rods 22 can not collapse in the branches 21, the conventional rods 23 are therefore not collapsed, too.

Figure 6:
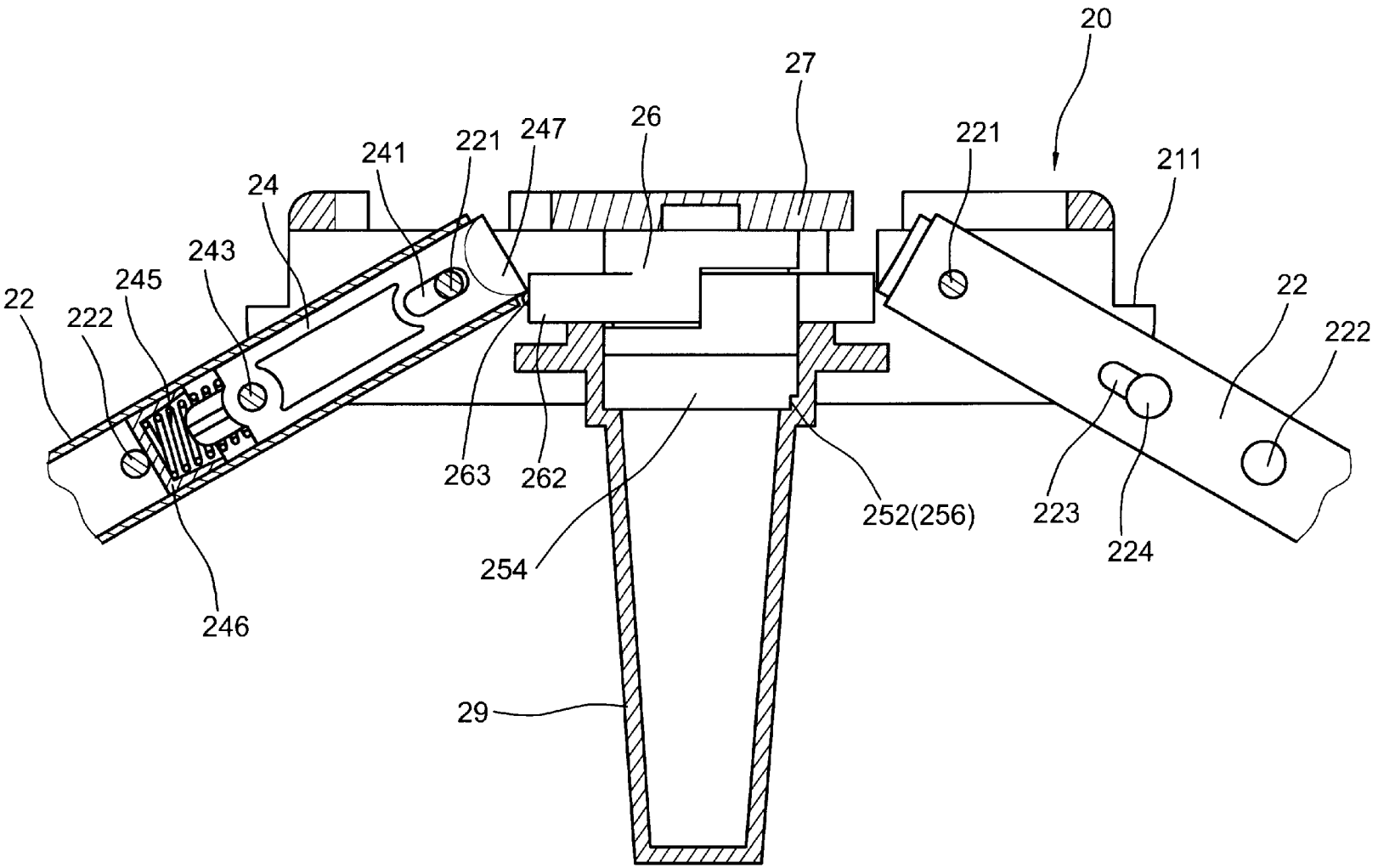
FIG. 6 is a sectional view to show that the pivotal seat is lifted upward where the elastic rods are collapsed.
Figure 8:
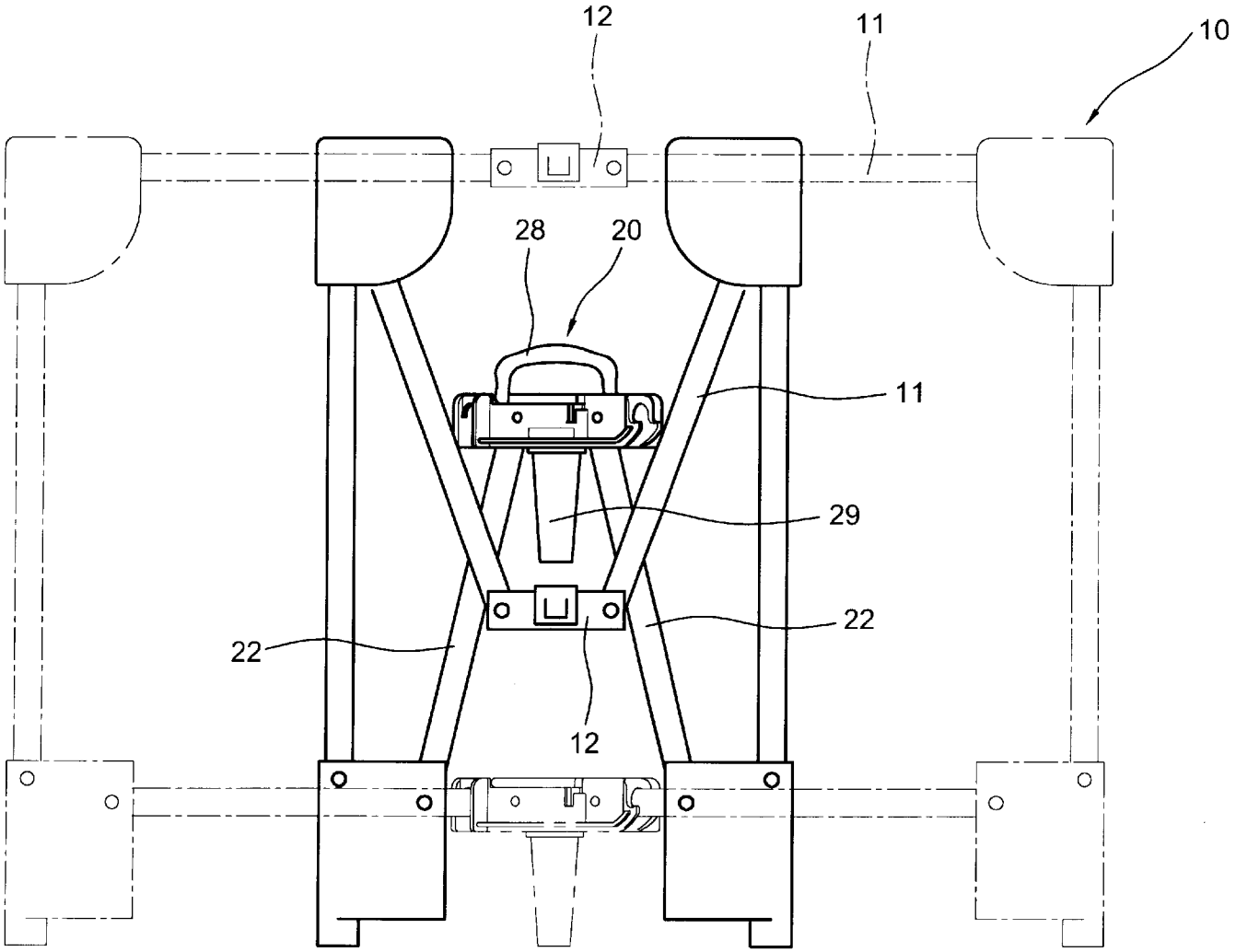
FIG. 8 is an elevational view to show that the playpen of FIG. 7 is being collapsed.

Referring to FIGS. 5, 6 and 8, when the handle 28 rotates the cover 27 clockwise for a predetermined angle, the pushing plates 272 of the cover 27 push the protrusions 262 of the rotors 26 to turn clockwise, too. Then the bevel portions 264 of the rotors 26 contact the bevel surfaces 247 of the sliders 24 to force the sliders 24 to move outward relative to the seat 20 where the slots 248 of the bevel surfaces 247 engage with the knot 263 of the protrusion 262 so that the rotors 26 are temporarily not turned back to their original positions. After the sliders 24 are moved outward, the rivet pins 224 are disengaged with the check surface 211. This time, the pivotal seat 20 can be lifted upward and both of the elastic rods 22 and the conventional rods 23 can be collapsed freely. Since the rivet pins 224 are moved downward along with the arcuate surfaces 212 of the branches 21, the slots 248 are naturely disengaged with the knot 263 and the rotors 26 can be able to turn back to their original positions. If collapses the playpen, the adapters 12 of the upper rods 11 of the playpen 10 should simultaneously be pushed down (as shown FIG. 8).

When presses the pivotal seat 20 downward, the elastic rods 22 and conventional rods 23 are immediately flatten to their horizontal positions. The rivet pins 224 of the elastic rods 22 are moving upward along with the arcuate surfaces 212 then stop against the check surfaces 211 of the branches 21. So that the flattening of the rods 22 and 23 are rather stable than the conventional collapsible playpen.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A pivotal seat for a collapsible playpen comprising:

a pivotal seat at a lower center of a collapsible playpen, said pivotal seat having four inverse U-shaped branches projected outward from four lateral sides respectively each including a first aligned thru hole in a pair of lateral walls thereof wherein two of said branches are parallel to each other each having a check surface on top of an outer end and an arcuate surface beneath said check surface for pivoting one end of a pair of elastic rods and the other two branches are perpendicular to said above branches for pivoting one end of a pair of conventional rods, the other end of said rods being pivoted to four lower corner members of said playpen respectively, said pivotal seat further including a foot projected downward from a bottom, a central bore in a top thereof above said foot, a first knot on an inner wall of said central bore, a pair of first vertical holes symmetrically formed in upper rims of said central bore, a pair of moving spaces symmetrically formed on upper rims of said central bore abutting said vertical holes and a pair of first slots symmetrically formed on upper rims of said central bore abutting said moving spaces respectively;

an inverse T-shaped member disposed into the central bore of said pivotal seat, a pair of rotors superimposedly wrapped on said inverse T-shaped member biased by a pair of coil springs on top and bottom thereof, a cover covering on said rotors and said coil springs and a semi-circular handle engaged with said cover;

whereby, by rotating said handle clockwise and simultaneously lift up said pivotal seat, the playpen is collapsible.

2. The pivotal seat as recited in claim 1 wherein said elastic rods each has a hollow interior, a second aligned thru hole adjacent a front end pivotally engaged with the first aligned thru hole of said branches and secured by a first rivet pin, a third aligned thru hole in a peripheral wall secured by a second rivet pin, a first oblong hole in a peripheral wall between said second and third aligned thru hole, a slider inserted into the hollow interior of said elastic rod, said slider having a beveled surface on a lateral side of a front end and including a second slot in a front center, said slider further including a second oblong hole through a lateral periphery adjacent said front end engaged with the first aligned thru hole and the first rivet pin of said branch, a radial hole adjacent rear end of said slider engaged with the first oblong hole of said elastic rod and slidably secured there to second by a third rivet pin, a projection extending outward from said rear end thereof, a spring biased on said projection and covered by a sleeve which stops against the second rivet pin of said elastic rod.

3. The pivotal seat as recited in claim 2 wherein said inverse T-shaped member has a circular body of a diameter equal to the diameter of the central bore of said pivotal seat, an axial tube centrally projected upward from top of said circular body, a third slot in a periphery of said circular body engaged with the first knot of said central bore and a slit in a peripheral wall of said axial tube thereof.

4. The pivotal seat as recited in claim 3 wherein said pair of rotors are symmetrically formed each having a second vertical hole in an outer rim, a protrusion on one side, a second knot centrally formed on an outer end of said protrusion engageable with the second slot of said sliders and a beveled portion on one side of said protrusion engageable with the beveled surface of said sliders.

5. The pivotal seat as recited in claim 4 wherein said pair of coil springs each has a vertical end inserted into the second vertical holes of said rotors and a transverse end inserted into the slit of said axial tube of said T-shaped member.

6. The pivotal seat as recited in claim 5 wherein said cover has a pair of arcuate holes symmetrically formed in top abutting circumferential edges and respectively engaged with the first vertical holes of said pivotal seat and rotatably secured by a pair of retaining pins, and a pair of pushing plates symmetrically formed on an under side for pushing the protrusions of said rotors and passing in and out of the first slot of said pivotal seat, a pair of inverse U-shaped thru holes symmetrically formed in two protrudent portions and a pair of reinforcement plates respectively positioned abutting said inverse U-shaped thru holes.

7. The pivotal seat as recited in claim 6 wherein said semicircular handle has a tang at each end facing toward each other for pivoting said handle to the pair of inverse U-shaped thru holes of said cover respectively.

8. The pivotal seat as recited in claim 1 said playpen further has a plurality of rails on a top portion each including an adapter at a middle portion thereof.

* * * * *